US010214377B2

(12) United States Patent
Dobashi et al.

(10) Patent No.: US 10,214,377 B2
(45) Date of Patent: Feb. 26, 2019

(54) SHEET PROCESSING APPARATUS

(71) Applicants: KABUSHIKI KAISHA TOSHIBA, Tokyo (JP); TOSHIBA TEC KABUSHIKI KAISHA, Tokyo (JP)

(72) Inventors: Shoichi Dobashi, Shizuoka (JP); Yoshihisa Hashimoto, Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/684,115

(22) Filed: Aug. 23, 2017

(65) Prior Publication Data

US 2018/0290851 A1 Oct. 11, 2018

(30) Foreign Application Priority Data

Apr. 6, 2017 (JP) ..... 2017-076232

(51) Int. Cl.
*B65H 29/20* (2006.01)
*B65H 31/02* (2006.01)
(Continued)

(52) U.S. Cl.
CPC ..... *B65H 29/20* (2013.01); *B65H 31/02* (2013.01); *B65H 31/3027* (2013.01); *B65H 31/3081* (2013.01); *B65H 31/34* (2013.01); *B65H 31/36* (2013.01); *B65H 31/38* (2013.01); *B65H 43/00* (2013.01); *G03G 15/6538* (2013.01); *G03G 15/6552* (2013.01); *B65H 5/062* (2013.01); *B65H 2301/4212* (2013.01); *B65H 2301/4213* (2013.01); *B65H 2301/4474* (2013.01);
(Continued)

(58) Field of Classification Search
CPC ..... B65H 29/20; B65H 2301/4223; B65H 31/00; B65H 31/26; B65H 31/02; B65H 31/3027; B65H 31/3081
See application file for complete search history.

(56) References Cited

U.S. PATENT DOCUMENTS 7,731,169 B2 * 6/2010 Saito ..... B65H 31/26 270/58.02
8,172,224 B2 5/2012 Kushida
(Continued)

OTHER PUBLICATIONS

European Search Report dated Sep. 10, 2018 received in corresponding European application No. 18 15 7133.2, 9 pages.

*Primary Examiner* — Thomas A Morrison
(74) *Attorney, Agent, or Firm* — Foley & Lardner LLP

(57) ABSTRACT

A sheet processing apparatus includes a processing tray, a conveyance roller, an extrusion member, a pinch roller and a controller. The conveyance roller is arranged at a downstream side of the processing tray in a sheet conveyance direction, and conveys the sheet. The extrusion member extrudes an end of an upstream side in the sheet conveyance direction of the sheet placed on the processing tray to the downstream side. The pinch roller moves to a rotation position at the time of conveying the sheet by the conveyance roller to sandwich the sheet with the conveyance roller. The controller controls the pinch roller and the conveyance roller to convey the sheet using the pinch roller and the conveyance roller when the sheet placed on the processing tray is conveyed to the downstream side in the sheet conveyance direction.

6 Claims, 10 Drawing Sheets

(51) Int. Cl.

| | |
|---|---|
| ***B65H 31/30*** | (2006.01) |
| ***B65H 31/34*** | (2006.01) |
| ***B65H 31/36*** | (2006.01) |
| ***B65H 31/38*** | (2006.01) |
| ***B65H 43/00*** | (2006.01) |
| ***G03G 15/00*** | (2006.01) |
| *B65H 5/06* | (2006.01) |

(52) U.S. Cl.

CPC ..... *B65H 2301/4478* (2013.01); *B65H 2405/11151* (2013.01); *B65H 2511/10* (2013.01); *B65H 2511/13* (2013.01); *B65H 2511/20* (2013.01); *B65H 2511/30* (2013.01); *B65H 2511/414* (2013.01); *B65H 2513/10* (2013.01); *B65H 2515/81* (2013.01); *B65H 2515/815* (2013.01); *B65H 2701/18292* (2013.01); *B65H 2801/06* (2013.01); *B65H 2801/27* (2013.01)

(56) References Cited

U.S. PATENT DOCUMENTS

| | | | | |
|---|---|---|---|---|
| 2006/0022395 | A1* | 2/2006 | Tanigami ..... | B42C 1/12 270/58.08 |
| 2007/0057425 | A1 | 3/2007 | Kamiya | |
| 2007/0063413 | A1 | 3/2007 | Terao et al. | |
| 2015/0123338 | A1 | 5/2015 | Iwata et al. | |

* cited by examiner

SHEET PROCESSING APPARATUS

CROSS-REFERENCE TO RELATED APPLICATION

This application is based upon and claims the benefit of priority from Japanese Patent application No. 2017-076232, filed Apr. 6, 2017, the entire contents of which are incorporated herein by reference.

FIELD

Embodiments described herein relate generally to a sheet processing apparatus.

BACKGROUND

There is known a sheet processing apparatus for executing a specified post-processing on a sheet (paper) conveyed from an image forming apparatus. The sheet processing apparatus includes a processing section for executing a post-processing and a standby section arranged above the processing section. The standby section temporarily retains subsequent sheets while the processing section executes the post-processing on the sheet. If the processing section is idle, the standby section drops the retained sheet towards the processing section. The sheet falling down to the processing section is subjected to a post-processing such as a sorting processing and a stapling processing. After the post-processing, an extrusion member of the processing section operates to extrude an edge of an upstream side in a conveyance direction of a sheet towards the downstream side. In this way, the sheet subjected to the post-processing is conveyed to the downstream side of the conveyance direction to be discharged from the processing section.

DETAILED DESCRIPTION

Figure 1:
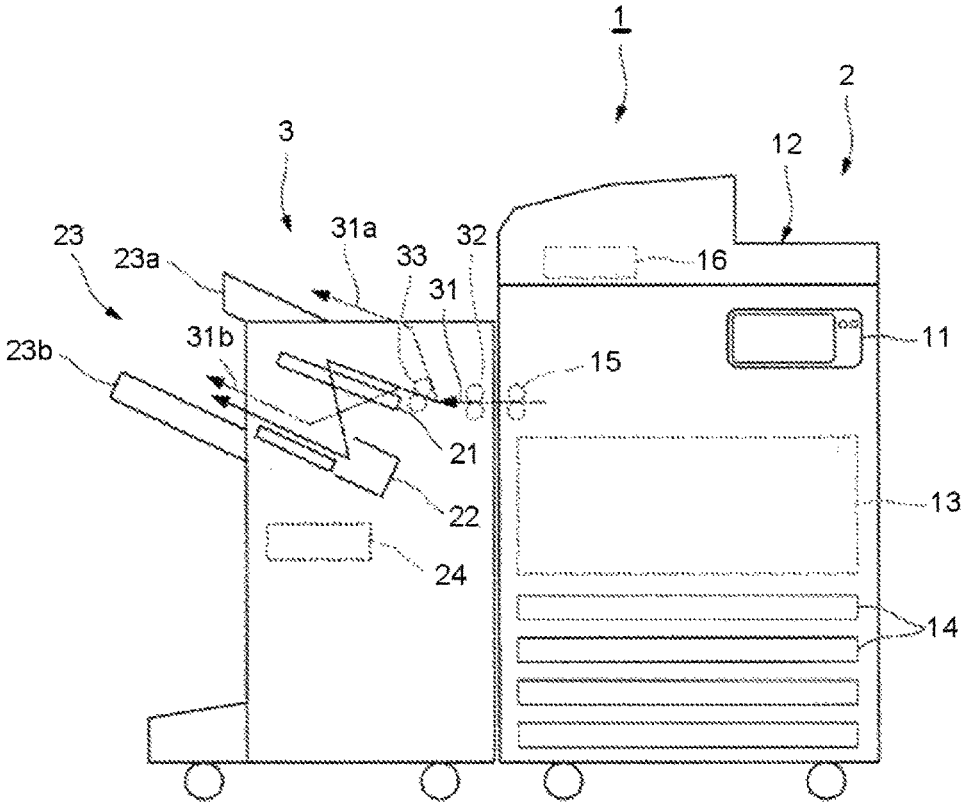
FIG. 1 is a front view illustrating an arrangement of an image forming system according to an embodiment.

A sheet conveyance system using an extrusion member of a processing section may not disturb a buffer operation of the sheet in a standby section, but is beneficial for performance improvement (speeding up). On the other hand, for example, in a case of an elongated sheet such as A3, especially for a sheet without stiffness, the sheet may buckle by pressing the sheet rear edge and a conveyance failure of the sheet may occur in some cases.

In accordance with an embodiment, a sheet processing apparatus comprises a processing tray, a conveyance roller, an extrusion member, a pinch roller and a controller. The processing tray places a sheet subjected to a post-processing. The conveyance roller is arranged at a downstream side of the processing tray in a sheet conveyance direction, and conveys the sheet to the downstream side in the sheet conveyance direction. The extrusion member extrudes an end of an upstream side in the sheet conveyance direction of the sheet placed on the processing tray from the upstream side to the downstream side in the sheet conveyance direction and conveys the sheet to the downstream side in the sheet conveyance direction. The pinch roller can be moved between a standby position apart from the conveyance roller and a rotation position close to the conveyance roller and moves to the rotation position at the time of conveying the sheet by the conveyance roller to sandwich the sheet with the conveyance roller. The controller controls the pinch roller and the conveyance roller to convey the sheet using the pinch roller and the conveyance roller if the sheet placed on the processing tray is conveyed to the downstream side in the sheet conveyance direction.

Hereafter, a sheet processing apparatus of an embodiment is described with reference to the accompanying drawings. In the following description, components having the same or similar function are designated with the same reference numeral. The overlapped description is omitted in some cases.

A sheet processing apparatus of one embodiment is described with reference to FIG. 1 to FIG. 10.

Figure 2:
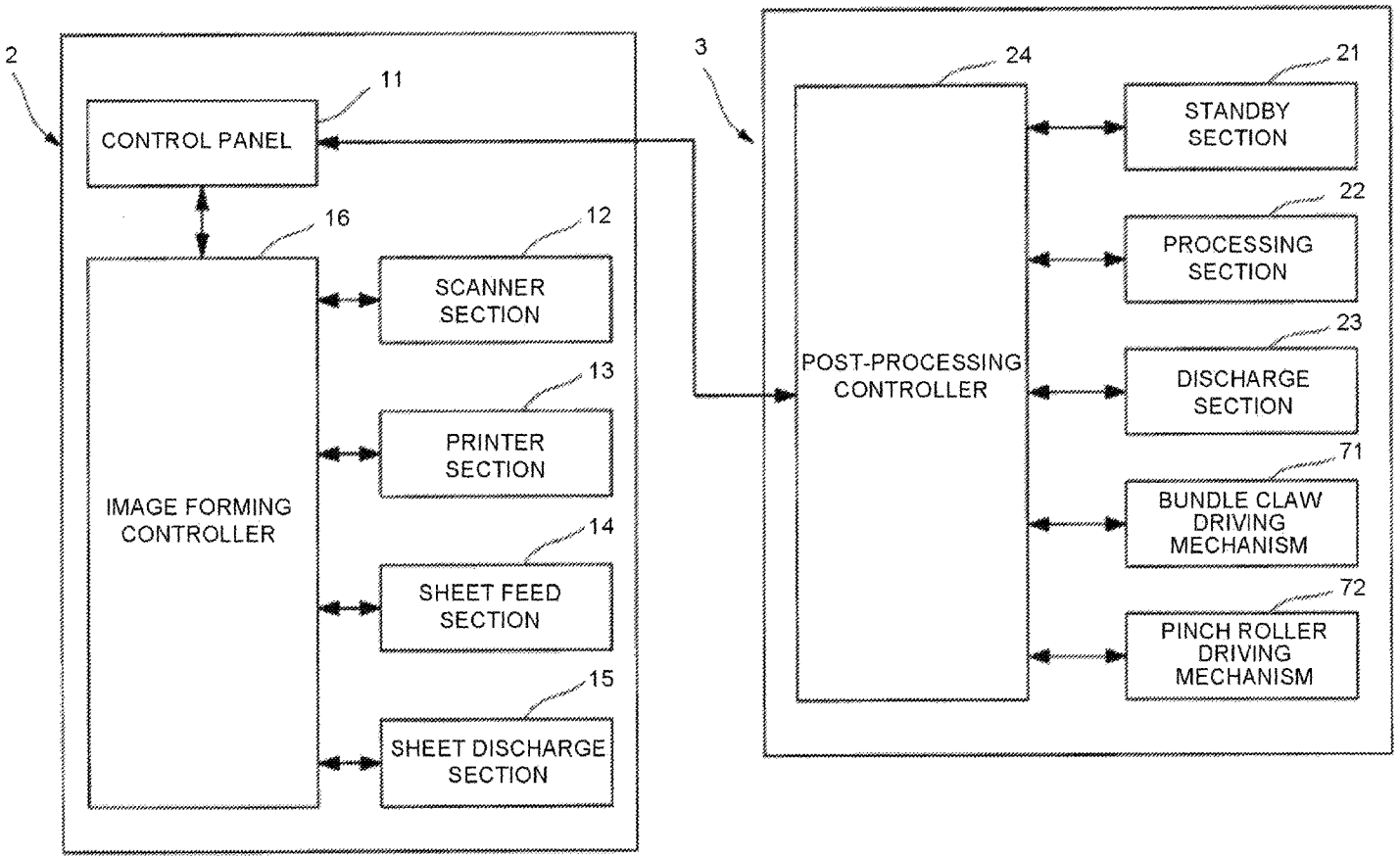
FIG. 2 is a block diagram illustrating an arrangement of the image forming system according to an embodiment.

FIG. 1 and FIG. 2 are block diagrams illustrating the arrangement of an image forming system 1. The image forming system 1 is provided with an image forming apparatus 2 and a post-processing apparatus 3. The image forming apparatus 2 forms an image on a sheet-like medium (hereinafter, referred to as a "sheet S") such as a paper. The post-processing apparatus executes a post-processing on a sheet S (including post-processing of a sheet bundle SS formed by overlapping a plurality of sheets S, in similar fashion) conveyed from the image forming apparatus 2. The post-processing apparatus 3 is an example of "a sheet post-processing apparatus".

The image forming apparatus 2 includes a control panel 11, a scanner section 12, a printer section 13, a sheet feed section 14, a sheet discharge section 15 and an image forming controller 16.

The control panel 11 is provided with various keys or a touch panel for receiving operations by a user. The control panel 11 receives an input relating to a type of a post-processing carried out on the sheet S. For example, the control panel 11 receives a selection of a sort mode in which a sorting processing is executed, a stapling mode in which a stapling processing is executed or a non-sort mode in which neither the sorting processing nor the stapling processing is executed. In a case in which the non-sort mode is selected, the control panel 11 receives selection of discharging the sheet S to later-described fixed tray 23*a* or movable tray 23*b* of the post-processing apparatus 3. Furthermore, the control panel 11 receives a selection of a sheet conveyance system if the sheet S is discharged to the movable tray 23*b*.

The image forming apparatus 2 sends information relating to the type of the post-processing input by the control panel 11 to the post-processing apparatus 3.

The scanner section 12 includes a reading section for reading an image to be copied. The scanner section 12 sends read image information to the printer section 13.

The printer section 13 forms an output image (hereinafter, referred to as a "toner image") by a developer such as a toner according to the image information sent from the scanner section 12 or an external device. The printer section 13 transfers the toner image onto the surface of the sheet S. The printer section 13 applies heat and pressure to the toner image transferred onto the sheet S to fix the toner image on the sheet S.

The sheet feed section 14 supplies sheets one by one to the printer section 13 in accordance with a timing at which the printer section 13 forms the toner image.

The sheet discharge section 15 conveys the sheet discharged from the printer section 13 to the post-processing apparatus 3.

The image forming controller 16 controls the whole operation of the image forming apparatus 2. The image forming controller 16 controls the control panel 11, the scanner section 12, the printer section 13, the sheet feed section 14 and the sheet discharge section 15. The image forming controller 16 is formed by a control circuit including a CPU (Central Processing Unit), a ROM (Read Only Memory), and a RAM (Random Access Memory).

Next, the post-processing apparatus 3 is described.

As shown in FIG. 1, the post-processing apparatus 3 is arranged adjacently to the image forming apparatus 2. The post-processing apparatus 3 executes the post-processing designated through the control panel 11 to the sheet S conveyed from the image forming apparatus 2. For example, the post-processing includes the sorting processing, the stapling processing, and the like.

The post-processing apparatus 3 includes a standby section 21, a processing section 22, a discharge section 23 and a post-processing controller (controller) 24.

Figure 3:
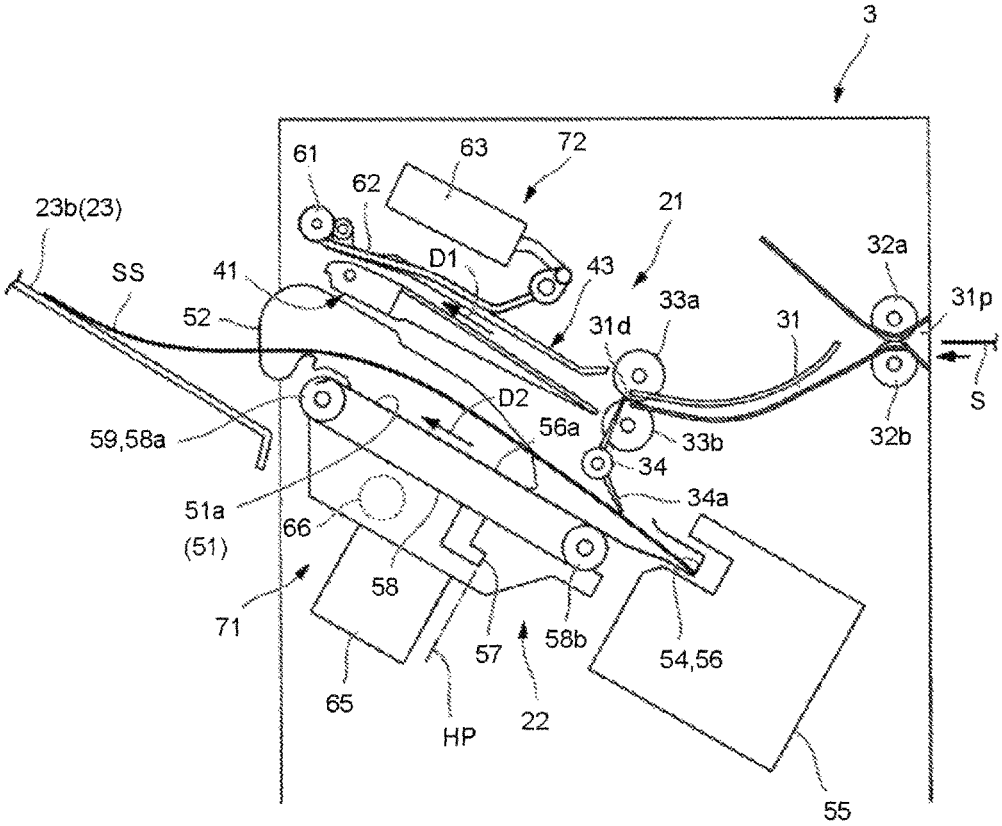
FIG. 3 is a side view illustrating an arrangement of a post-processing apparatus in the image forming system according to an embodiment.

Referring to FIG. 3, the standby section 21 temporarily retains (buffers) the sheet S conveyed from the image forming apparatus 2. The standby section 21 includes a standby tray 41. For example, one or a plurality of succeeding sheets S stands by on the standby section 21 while the post-processing is executed on the former sheet S by the processing section 22. The standby section 21 is arranged above the processing section 22. For example, on the standby section 21, a plurality of sheets S stands by in an overlapped manner. If the processing section 22 is idle, the standby section 21 drops the sheet S that is being buffered towards the processing section 22.

The processing section 22 carries out the post-processing on the conveyed sheet S. The processing section 22 includes a processing tray 51. For example, the processing section 22 executes the sorting processing for gathering a plurality of sheets S to align them. For example, the processing section 22 carries out the stapling processing of stapling a sheet bundle SS obtained by gathering a plurality of sheets S. The processing section 22 discharges the sheet S on which the post-processing is carried out to the discharge section 23.

As shown in FIG. 1, the discharge section 23 includes the fixed tray 23*a* and the movable tray 23*b*. The fixed tray 23*a* is arranged at an upper side of the post-processing apparatus 3. The movable tray 23*b* is arranged on a side surface of the post-processing apparatus 3. The movable tray 23*b* can move in a vertical direction along the side surface of the post-processing apparatus 3. A sheet S is discharged from the standby section 21 and the processing section 22 to the fixed tray 23*a* or the movable tray 23*b*.

The post-processing controller 24 controls the whole operation or the post-processing apparatus 3. The post-processing controller 24 controls the standby section 21, the processing section 22 and the discharge section 23. The post-processing controller 24 controls the operations of inlet rollers 32*a* and 32*b*, outlet rollers 33*a* and 33*b* and an assisting guide 43 and controls the operations of a bundle claw driving mechanism 71 and a pinch roller driving mechanism 72. Like the image forming controller 16, the post-processing controller 24 is formed by a control circuit including a CPU, a ROM and a RAM.

The configuration of each section of the post-processing apparatus 3 is described in detail.

In the present embodiment, the "sheet conveyance direction" is indicated by an arrow D1 in the standby section 21 and by an arrow D2 in the processing section 22. The arrow D1 means the conveyance direction (an entry direction of the sheet S to the standby tray 41) of the sheet S in the standby tray 41. The arrow D2 means the conveyance direction (a discharge direction of the sheet S from the processing tray 51) of the sheet S in the processing tray 51.

The "upstream side" and "the downstream side" referred to in the present embodiment mean an upstream side (the image forming apparatus 2 side) and a downstream side in the sheet conveyance direction, respectively. In addition, "front end" and "rear end" referred to in the present embodiment respectively mean a "downstream side end" and an "upstream side end" in the sheet conveyance direction, respectively. Furthermore, in the present embodiment, a direction (a sheet plane direction) substantially parallel to a plane of the sheet S and substantially orthogonal to the sheet conveyance direction is referred to as a sheet width direction W.

As shown in FIG. 3, the post-processing apparatus 3 includes a conveyance path 31 of the sheet S, a pair of inlet rollers 32*a* and 32*b*, a pair of outlet rollers 33*a* and 33*b*, the standby section 21 and the processing section 22.

The conveyance path provided inside the post-processing apparatus 3. The conveyance path 31 has a sheet supply port 31*p* and a sheet discharge port 31*d*. The sheet supply port 31*p* faces the image forming apparatus 2. The sheet supply port 31*p* is supplied with the sheet S from the image forming apparatus 2. The sheet discharge port 31*d* faces the standby section 21. The sheet S passing through the conveyance path 31 is conveyed from the sheet discharge port 31*d* to the standby section 21.

As shown in FIG. 1, from the conveyance path 31, a second conveyance path 31*a* extending to the fixed tray 23*a* of the discharge section 23 branches. In the non-sort mode, if the fixed tray 23*a* is selected as a discharge destination of the sheet S, the second conveyance path 31*a* guides the sheet S supplied to the sheet supply port 31*p* towards the fixed tray 23*a*.

If the sort mode or the stapling mode is selected, the conveyance path 31 guides the sheet S supplied to the sheet supply port 31*p* to the standby section 21. The conveyance path 31 guides the sheet S supplied by the sheet supply port 31*p* directly to the processing section 22 if the movable tray 23*b* is selected as the discharge destination of the sheet S in the non-sort mode. From the conveyance path 31, a third conveyance path 31*b* extending towards the conveyance roller 59 at the downstream side in the conveyance direction of the processing section 22 branches. In FIG. 1, the inlet rollers 32*a* and 32*b* are indicated by reference numeral 32, and the outlet rollers 33*a* and 33*b* are indicated by reference numeral 33.

Referring to FIG. 3, the inlet rollers 32*a* and 32*b* are provided in the vicinity of the sheet supply port 31*p*. The inlet rollers 32*a* and 32*b* face each other in a radial direction in parallel. The inlet roller 32*a* is a driving roller arranged above the conveyance path 31. The inlet roller 32*b* is a driven roller arranged below the conveyance path 31. The inlet rollers 32*a* and 32*b* sandwich the sheet S at a nip therebetween. The inlet rollers 32*a* and 32*b* convey the sandwiched sheet S to the downstream side in the conveyance direction.

The outlet rollers 33*a* and 33*b* are provided in the vicinity of the sheet discharge port 31*d*. The outlet rollers 33*a* and 33*b* face each other in a radial direction in parallel. The outlet roller 33*a* is a driving roller arranged above the conveyance path 31. The outlet roller 33*b* is a driven roller arranged below the conveyance path 31. The outlet rollers 33*a* and 33*b* sandwich the sheet S at a nip therebetween. The outlet rollers 33*a* and 33*b* convey the sandwiched sheet S to the downstream side in the conveyance direction.

The standby section 21 is described.

As shown in FIG. 3, the standby section 21 includes the standby tray (buffer tray) 41 and an assisting guide 43.

The rear end of the standby tray 41 is positioned in the vicinity of the outlet roller 33*a* and 33*b*. The rear end of the standby tray 41 is positioned below the sheet discharge port 31*d* of the conveyance path 31. The standby tray 41 is inclined with respect to a horizontal direction in such a manner that it gradually increases as proceeding to the downstream side of the sheet conveyance direction D1. On the standby tray 41, a plurality of the sheets S stands by in an overlapped manner while the post-processing is executed in the processing section 22.

The standby tray 41 has a pair of tray members that can move towards or away from each other in the sheet width direction W. The pair of tray members approaches to each other to be capable of supporting the sheet S if the sheet S stands by on the standby tray 41. If the sheet S moves from the standby tray 41 towards the processing tray 51 of the processing section 22, the pair of the tray members is apart from each other to drop (move) the supported sheet S to the processing tray 51.

The assisting guide 43 is provided above the standby tray 41. For example, the assisting guide 43 has substantially the same length as the standby tray 41 in the sheet conveyance direction D1. If the sheet S moves from the standby tray 41 to the processing tray 51, the assisting guide 43 directs the sheet S towards the processing tray 51. The assisting guide 43 has a swing axis at the end of the downstream side of the sheet conveyance direction D1. The assisting guide 43 swings the end of the upstream side of the sheet conveyance direction D1 below to direct the sheet S toward the processing tray 51.

Between the upstream side of the standby tray 41 and the upstream side of the processing tray 51, a paddle section 34 is provided. The paddle section 34 presses the sheet S towards the processing tray 51 by rotating around a rotation axis along the sheet width direction W. The paddle section 34 presses the sheet S towards the processing tray 51 at the time the sheet S moves from the standby tray 41 to the processing tray 51. The paddle section 34 has a paddle 34*a* made of an elastic material such as rubber, and the paddle 34*a* presses the sheet S toward the processing tray 51. The paddle section 34 rotates counterclockwise in the figure with the paddle 34*a* contacting the sheet S. As a result, the sheet S falling down on the processing tray 51 moves towards the upstream side in the sheet conveyance direction D2 of the processing section 22. The paddle section 34, together with a conveyance roller 59 and a rear end stopper 54 of the processing section 22, forms a longitudinal alignment device which executes alignment of the sheet S (a so-called longitudinal alignment) in the sheet conveyance direction D2.

The processing section 22 is described.

As shown in FIG. 3, the processing section 22 includes a processing tray 51, a horizontal alignment plate 52, the rear end stopper 54, stapler (stapling processing section) 55, an ejector 56, a thruster 56*a*, a bundle claw (extrusion member or extruder) 57, a bundle claw belt 58 and the conveyance roller (longitudinal alignment roller) 59.

The processing tray 51 is provided below the standby tray 41. The processing tray 51 is inclined with respect to the horizontal direction in such a manner that it gradually increases as proceeding to the downstream side of the sheet conveyance direction D2. For example, the processing tray 51 is inclined approximately parallel to the standby tray 41. The processing tray 51 has a conveyance surface 51*a* (on which the sheet S is placed) supporting the sheet S.

The horizontal alignment plate 52 is provided at both sides of the sheet width direction W of the conveyance surface 51*a* of the processing tray 51. A pair of the horizontal alignment plates 52 is provided apart from each other in the sheet width direction W. The horizontal alignment plate 52 moves in a direction approaching to each other and a direction away from each other in the sheet width direction W. The horizontal alignment plate 52 forms a horizontal alignment device (an aligner) which executes the alignment (so-called horizontal alignment) of the sheet S in the sheet width direction W.

The rear end stopper 54 is provided at the end of the upstream side of the processing tray 51. The sheet S placed on the processing tray 51 is conveyed to the rear end stopper 54 if the conveyance roller 59 is reversely driven to rotate clockwise in the figure. The conveyance roller 59 cooperates with the paddle section 34 and executes the longitudinal alignment of the sheet S by causing the upstream side end of the sheet S to abut against the rear end stopper 54.

The stapler 55 is positioned behind the processing tray 51. The stapler 55 can clinch the end of the sheet S aligned by abutting against the rear end stopper 54. If the stapling mode is selected, the stapler 55 executes the stapling processing at the end of the sheet bundle SS aligned by abutting against the rear end stopper 54.

The ejector 56 is provided at the end of the upstream side of the processing tray 51. The ejector 56 is provided so as to overlap the rear end stopper 54 in a side view. The ejector 56 is movable towards the downstream side of the sheet conveyance direction D2. The ejector 56 advances the sheet bundle SS on which the stapling processing or the sorting processing is executed at the time of moving to the downstream side of the conveyance direction. The ejector 56 places the end of the sheet bundle SS at a position where the sheet bundle SS can be delivered to the bundle claw 57. The ejector 56 is moved towards the initial position before the movement.

The thruster 56*a* is arranged along the conveyance surface 51*a*. The thruster 56*a* is movable with the ejector 56 towards the downstream side of the sheet conveyance direction D2. The thruster 56*a* protrudes towards the downstream side in the conveyance direction from the conveyance roller 59 if moving to the downstream side n the conveyance direction. The thruster 56*a* protrudes so as to extend the conveyance surface 51*a* from the conveyance roller 59 to the downstream side in the conveyance direction. The thruster 56*a* is moved in the upstream side in the conveyance direction rather than the conveyance roller at an initial position before the movement. The thruster 56*a* is moved towards the initial position before the movement.

The bundle claw 57 is fixed to the bundle claw belt 58. The bundle claw belt 58 is wound around a pair of belt rollers 58*a* and 58*b* positioned at the upstream side and the downstream side in the conveyance direction of the processing tray 51. The belt roller 58*a* at the downstream side in the conveyance direction is provided so as to overlap with the conveyance roller 59. The belt roller 58*a* at the downstream side in the conveyance direction is the driving roller, and the bundle claw belt 58 rotates by the rotation of the driving roller. The bundle claw belt 58 and the belt rollers 58*a* and 58*b* form the bundle claw driving mechanism 71 for driving the bundle claw 57.

The bundle claw 57 moves along a winding direction of the bundle claw belt 58 along with driving of the bundle claw belt 58. The bundle claw 57 contacts with the end at the upstream side in the conveyance direction of the sheet S placed on the processing tray 51 to convey the sheet S so as to press the sheet S to the downstream side in the conveyance direction of the processing tray 51. The bundle claw 57 moves to the downstream side of the sheet conveyance direction D2 at the upper surface side (the conveyance surface 51*a* side) of the processing, tray 51. The bundle claw 57 moves to the lower surface side along the outer circumference of the belt roller 58*a* at the front end side of the processing tray 51 after the sheet S is conveyed. Thereafter, the bundle claw 57 moves the lower surface side of the processing tray 51 to the upstream side of the sheet conveyance direction D2. The bundle claw 57 stands by with a position in the front of the belt roller 58*b* at the rear end side of the processing tray 51 set as a home position HP. The bundle claw 57 moves toward the conveyance surface 51*a* side along the outer circumference of the belt roller 58*b* at the rear end side of the processing tray 51 from the home position HP and conveys the sheet bundle SS delivered from the ejector 56.

The bundle claw driving mechanism 71 is provided with a bundle claw driving motor 65 as a driving source shared by the bundle claw 57 (belt roller 58*a*), the ejector 56 and the thruster 56*a*. The bundle claw driving motor 65 may be connected to the belt roller 58*a*, but may be connected to the ejector 56 and the thruster 56*a* so as to be capable of being disconnected via an electromagnetic clutch 66. The bundle claw driving mechanism 71 advances the ejector 56 and the thruster 56*a* with the driving force of the bundle claw driving motor 65 only if the electromagnetic clutch 66 is ON (connected). The ejector 56 and the thruster 56*a* return to the initial positions before the advance by its own energization force if the electromagnetic clutch 66 is OFF (disconnected).

If the belt roller 58*a* is driven to rotate in the counterclockwise direction in the figure, the bundle claw 57, the ejector 56 and the thruster 56*a* move the upper surface of the conveyance surface 51*a* of the processing tray 51 towards the downstream side the conveyance direction (left side in the figure). If the belt roller 58*a* is reversely driven to rotate in the clockwise direction in the figure, the bundle claw 57, the ejector 56 and the thruster 56*a* move the upper surface of the conveyance surface 51*a* of the processing tray 51 to the upstream side in the conveyance direction (right side in the figure).

The conveyance roller 59 conveys the sheet S placed on the processing tray 51 toward the movable tray 23*b* of the discharge section 23 by forward driving counterclockwise in the figure. The conveyance roller 59 applies a driving force to the sheet S by contacting the sheet S placed on the processing tray 51 from below. At this time, as shown in FIG. 3, if the sheet S bends and moves away from the conveyance roller 59, the driving force of the conveyance roller 59 cannot be applied to the sheet S. Thus, above the processing tray 51 (above the standby tray 41 in an embodiment), there is a pinch roller 61 which sandwiches the sheet S with the conveyance roller 59.

A pinch roller 61 according to at least one embodiment is a driven roller without a driving source. The pinch roller 61 is movable between a standby position (refer to FIG. 3) positioned above the standby tray 41 and a rotation position facing the conveyance roller 59 (refer to FIG. 4). The pinch roller 61 is driven by a pinch roller driving mechanism 72 to move between the standby position and the rotation position. The pinch roller 61 sandwiches the sheet S with the conveyance roller 59 by moving to the rotation position in this way, it is possible to stably transmit the driving force of the conveyance roller 59 to the sheet S.

Figure 4:
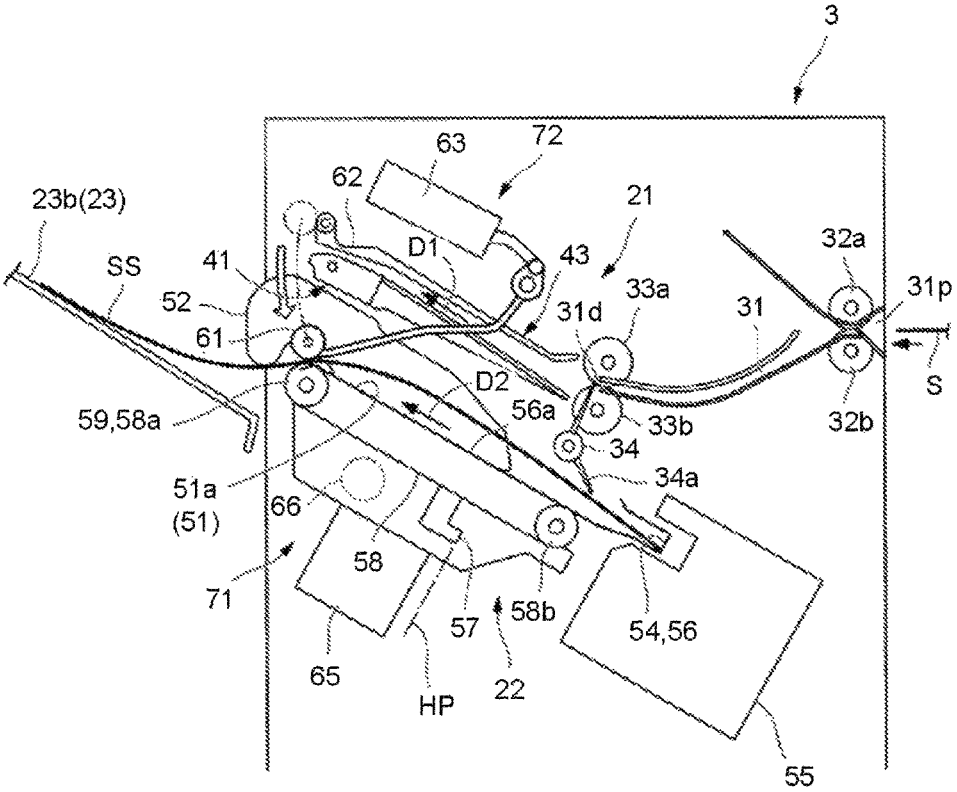
FIG. 4 is a side view illustrating a first operation by a post-processing apparatus according to an embodiment.

The pinch roller driving mechanism 72 includes a support arm 60 for supporting the pinch roller 61 at the front end while abase end (rear end) thereof is supported in a swingable manner around an axis along the sheet width direction W, and a solenoid 63 connected to the base end of the support arm 62. As shown in FIG. 3, if the solenoid 63 causes a plunger to protrude backward, the pinch roller 61 swings upward through the support arm 62 and moves to the standby position. As shown in FIG. 4, if the solenoid 63 moves the plunger forward, the pinch roller 61 swings downward through the support arm 62 and moves to the rotation position.

In the non-sort mode, if the movable tray 23*b* is selected as the discharge destination of the sheet S in the post-processing apparatus 3, the sheet S supplied to the sheet supply port 31*p* is conveyed from the third conveyance path 31*b* to the conveyance roller 59 of the processing tray 51 without passing through the standby tray 41. The sheet S is discharged to the movable tray 23*b* by the conveyance roller 59 of the processing tray 51.

In the present embodiment, "without passing through the standby tray 41" means that the sheet S is not buffered on the standby tray 41 (in other words, the sheet S is not retained on the standby tray 41). "Without passing through the standby tray 41" in the present embodiment includes that the sheet S passes between a pair of tray members of the standby tray 41 separated from each other in the sheet width direction W "Without passing through the standby tray 41" in the present embodiment may include a case in which the sheet S contacts with a part of the standby tray 41 depending on the shape of the standby tray 41.

The third conveyance path 31*b* passes through a relatively large step and space toward the conveyance roller 59 of the processing tray 51. Therefore, the processing tray 51 may be provided with a slope-like guide (not shown) which appears on the conveyance surface 51*a*. Thereby, in the non-sort mode, if the movable tray 23*b* is selected as the discharge destination of the sheet S, the sheet S conveyed from the third conveyance path 31*b* can be guide steadily to the conveyance roller 59 of the processing tray 51.

If the fixed tray 23*a* is selected as the discharge destination of the sheet S in the non-sort mode, the post-processing controller 24 controls a branching member (not shown) to transfer the sheet S to the second conveyance path 31*a* and then discharge the sheet S to the fixed tray 23*a*.

In addition, if the sort mode or the stapling mode is selected, the post-processing controller 24 controls the branching member to send the sheet S to the conveyance path 31, and then convey the sheet S to the standby section 21. Thereafter, by controlling the standby section 21 and the processing section 22, the sheet S subjected to the buffer and the post-processing is discharged to the movable tray 23*b*.

As shown in FIG. 3, the home position HP of the bundle claw 57 is positioned under the bundle claw belt 58. If the bundle claw 57 is at the home position HP, if the bundle claw belt 58 starts driving, the bundle claw 57 moves to the upstream side. Thereafter, the bundle claw 57 moves to the upper side (the conveyance surface 51*a* side) of the bundle claw belt 58 along the outer circumference of the belt roller 58*b* at the rear end side. Thereafter, the bundle claw 57 presses the sheet bundle SS to the downstream side to discharge it while moving to the downstream side along the conveyance surface 51*a*. The post-processing controller 24 can detect that the bundle claw 57 is at the home position HP with a sensor (not shown).

If the movable tray 23*b* is selected as the discharge destination of the sheet S in the non-sort mode, the post-processing controller 24 conveys the sheet S from the third conveyance path 31*b* to the conveyance roller 59 of the processing section 22. Specifically, the post-processing controller 24 controls the standby tray 41 to separate the par of tray members of the standby tray 41. In this way, the sheet S directs from the third conveyance path 31*b* to the conveyance roller 59 without passing through the standby tray 41 (not placed on the standby tray 41).

If the sheet S is sent from the third conveyance path 31*b* to the conveyance roller 59, the post-processing controller 24 controls the pinch roller driving mechanism 72 so as to move the pinch roller 61 to the rotation position. As a result, the sheet S guided to the conveyance roller 59 is sandwiched between the conveyance roller 59 and the pinch roller 61 to be reliably applied with the driving force and is stably discharged towards the movable tray 23*h*. After discharging the sheet S, the post-processing controller 24 raises the pinch roller 61 to the standby position by controlling the pinch roller driving mechanism 72. In this way, it is possible to place a next sheet S on the processing tray 51.

In a case in which the sort mode or the stapling mode is selected, if the rear end of the sheet bundle SS is pressed at the bundle claw 57 to be discharged, there is a case in which the sheet bundle SS buckles. For example, if the sheet S is thin and soft, and it has a large size such as A3 and the number of the sheets S is small, the sheet bundle SS is low in rigidity and is easy to bend. Therefore, at the time the bundle claw 57 presses the rear end of the sheet bundle SS, the sheet bundle SS buckles. If the sheet S buckles, the sheet S moves away from the conveyance roller 59, no driving force is applied, and the sheet S cannot be moved to the movable tray 23*b*. Even if the bundle claw 57 further extrudes the sheet S in a buckled state, the sheet S further curves by bending, and the conveyance failure of the sheet S also occurs at this point.

Therefore, in the present embodiment, in a case of conveying the sheet S subjected to the post-processing in the processing tray 51 to the downstream side in the sheet conveyance direction 52, the pinch roller 61 and the conveyance roller 59 are controlled to convey the sheet by using the pinch roller 61 and the conveyance roller 59.

The post-processing controller 24 controls the pinch roller 61 and the conveyance roller 59 to convey the sheet by using the pinch roller 61 and the conveyance roller 59 if the sheet S placed on the processing tray 51 is conveyed to the downstream side in the sheet conveyance direction D2.

Specifically, the post-processing controller 24 controls the pinch roller driving mechanism 72 to move the pinch roller 61 to the rotation position and can convey the sheet using the pinch roller 61 and the conveyance roller 59 in a case of conveying the sheet S subjected to the post-processing in the processing tray 51 to the downstream side in the sheet conveyance direction D2.

In addition, the post-processing controller 24 controls the bundle claw driving mechanism 71 to stop the operation of the bundle claw 57 in a case of conveying the sheet S subjected to the post-processing in the processing tray 51 to the downstream side in the sheet conveyance direction D2. In this way, the upstream side end of the sheet S is not extruded by the bundle claw 57. Therefore, even in a case of conveying the sheet S which is soft and large and has low rigidity, the sheet s is prevented from bucking, and the conveyance failure can be suppressed.

The operation of moving the pinch roller 61 to the rotation position to sandwich the sheet S is executed after the longitudinal alignment and horizontal alignment of the sheet S are completed.

In a state in which the pinch roller 61 moves to the rotation position to sandwich the sheet S with the conveyance roller 59, there is a possibility of hindering the alignment processing of the sheet S. In the present embodiment, before the alignment processing is completed, the pinch roller 61 moves to the standby position, and the pinch roller 61 moves to the rotation position after the alignment processing is completed. Thus, the alignment processing can be executed without being influenced by pinching of the pinch roller 61.

In addition, the post-processing controller 24 connects with the electromagnetic clutch 66 of the bundle claw driving mechanism 71 after starting conveying the sheet S by the pinch roller 61 and the conveyance roller 59, and the bundle claw driving motor 65 advances the thruster 56*a*.

The soft sheet S may hang down immediately after leaving the conveyance roller 59 to curl or contact with the movable tray 23*b*. However, the thruster 56*a* contacts with the lower surface of the sheet S to support the sheet, and thus, the occurrence of hanging of the sheet S and the conveyance failure of the sheet S can be suppressed.

The post-processing controller 24 causes the thruster 56*a* in the upstream side to return to the initial position after the sheet S is conveyed to the movable tray 23*b*.

Therefore, the upstream side end of the sheet S on the movable tray 23*b* does not become a state of contacting with the thruster 56*a*, and the conveyance failure of the sheet S can be suppressed. If the thruster 56*a* is moved from the state in which the upstream side end of the sheet S on the movable tray 23*b* contacts with the thruster 56*a*, the sheet S may be returned to the upstream side by the movement of the thruster 56*a*. In this case, there is a case in which the upstream side end of the sheet S reaches the exit of the processing tray 51. If there is a sheet sensor under the exit of the processing tray 51, there is a possibility that the detection of the sheet S by the sheet sensor is delayed, which may affect an appropriate sheet discharge operation such as adjusting the height of the movable tray 23*b*.

The bundle claw driving mechanism 71 advances the ejector 56 from the upstream side in the conveyance direction to the downstream side as the thruster 56*a* advances. Furthermore, the bundle claw driving mechanism 71 moves the bundle claw 57 along the winding direction of the bundle claw belt 58 from the home position HP below the processing tray 51 as the thruster 56*a* advances.

Thus, the post-processing controller 24 moves the ejector 56 to the downstream side at a speed equal to or less than the sheet conveyance speed by the conveyance roller 59 at the time of conveying the sheet by the conveyance roller 59. At this time, the post-processing controller 24 moves the bundle claw 57 to the downstream side in the belt winding direction at a speed equal to or lower than the sheet conveyance speed by the conveyance roller 59 at the time of conveying the sheet by the conveyance roller 59.

By setting "the sheet conveyance speed by the conveyance roller 59"≥"moving speed of the ejector 56 and the bundle claw 57", the conveyance speed of the downstream side of the sheet S is higher than that of the upstream side. Therefore, it is possible to prevent the ejector 56 and the bundle claw 57 from, pressing the upstream side in the conveyance direction end of the sheet S to cause buckling. The ejector 56 and the bundle claw 57 support the sheet conveyance even if the conveyance roller 59 slips at the time of carrying the sheet by the conveyance roller 59. The ejector 56 and the bundle claw 57 and the conveyance roller 59 can cooperate to convey the sheet S, and the conveyance failure can suppressed while suppressing the buckling of the sheet S.

The sheet conveyance speed by the conveyance roller 59 varies according to at least one of the size or type of the sheet S.

According to the size (including a fixed form and a non-fixed form) and type (paper quality, basis weight (thickness) etc.) of the sheet S, the post-processing controller 24 automatically or manually changes the sheet conveyance speed by the conveyance roller 59. In a case of automatically changing the sheet conveyance speed by the conveyance roller 59, a sensor is provided to detect the size and type of the sheet S. Based on the detection information of the sensor, the post-processing controller 24 controls the driving speed of the conveyance roller 59. In a case of manually changing the sheet conveyance speed by the conveyance roller 59, the post-processing controller 24 controls the driving speed of the conveyance roller 59 based on a prescribed operation for the control panel 11. In this way, it is possible to set the optimum conveyance speed according to the sheet S and suppress the conveyance failure.

As an example of a method to change the conveyance speed, for example, if the size of the sheet S is large, the conveyance speed is slowed down to prevent buckling of the sheet S during the sheet conveyance. For example, a conveyance speed of the sheet S of a predetermined sheet size (for example, A4 size) is set as V1, and the conveyance speed V1 is set as an initial value (reference value) at the time of conveying the sheet. In this case, in a case of conveying the sheet S having a size larger than the A4 size (for example, A3 size), the sheet S is conveyed by setting a conveyance speed V2 slower than the conveyance speed V1.

Further, if the basis weight of the sheet S is large, the conveyance speed is increased. In a case of conveying the sheet S having the basis weight W1, a conveyance speed V3 is set. In a case of conveying the sheet S having a basis weight W2 larger than the basis weight the sheet S is conveyed at a conveyance speed V4 which is faster than the conveyance speed V3 of the sheet S having the basis weight W1.

The post-processing controller 24 mutually deviates the timing of the operation that the pinch roller 61 sandwiches the sheet bundle SS and the operation that the stapler 55 binds the sheet bundle SS at the time of conveying the sheet by the conveyance roller 59.

If the impact of sandwiching the sheet bundle SS is transmitted to a sheet stapling position at the time the pinch roller 61 sandwiches the sheet bundle SS, the sheet stapling position deviates in some cases. For this reason, the operation in which the pinch roller 61 sandwiches the sheet bundle SS and the operation in which the stapler 55 binds the sheet bundle SS are executed at different timing. As a result, it is possible to suppress the occurrence of deviation of the sheet stapling position based on the operation in which the pinch roller 61 sandwiches the sheet bundle SS. At this time, by executing the operation of stapling the sheet bundle SS first, it is possible to execute the sheet stapling processing with the same accuracy as the existing sheet stapling processing without sandwiching the sheet bundle SS by the pinch roller 61.

The post-processing controller 24 switches the sheet conveyance by the bundle claw 57 and the sheet conveyance by the conveyance roller 59 according to the number of sheets in the sheet bundle SS.

If the number of the sheets in the sheet bundle SS is large, it becomes difficult to buckle the sheet S in the longitudinal direction or the sheet S which is easy to bend. On the other hand, if the number of the sheets in the sheet bundle SS is large, the sheet conveyance becomes difficult with the driving force of the conveyance roller 59 contacting with one side of the sheet bundle SS. Therefore, if the sheet bundle SS has a large number of sheets, that the sheet conveyance by the bundle claw 57 is executed can be switched automatically or manually (prescribed operation). In this way, it is possible to prevent the conveyance failure due to the large number of sheets in the sheet bundle SS.

The post-processing controller 24 can switch the sheet conveyance by the pinch roller 61 and the conveyance roller 59 and the sheet conveyance by the bundle claw 57 through an operation by a user on the control panel 11.

In this way, it is possible to switch the sheet conveyance using the pinch roller 61 and the conveyance roller 59 and the sheet conveyance for extruding the end at the upstream side of the sheet S according to the intention of the user. If the pinch roller 61 is at the rotation position, the sheet S cannot be buffered on the standby tray 41, and the sheet processing time is lengthened. Therefore, by switching the sheet conveyance system by a user operation, usability can be improved while suppressing the conveyance failure. In a case of conveying the long sheet S or the sheet S which is easy to bend, the sheet conveyance by the pinch roller 61 and the conveyance roller 59 is selectively executed. In this way, it is possible to suppress the conveyance failure of the sheet S. In other cases (in case of conveying a sheet such as relatively small sheet S or plain paper), the standby tray 41 can be used as the sheet conveyance by the bundle claw 57. In this way, it is possible to shorten the sheet processing time (speed up the sheet processing).

Figure 8:
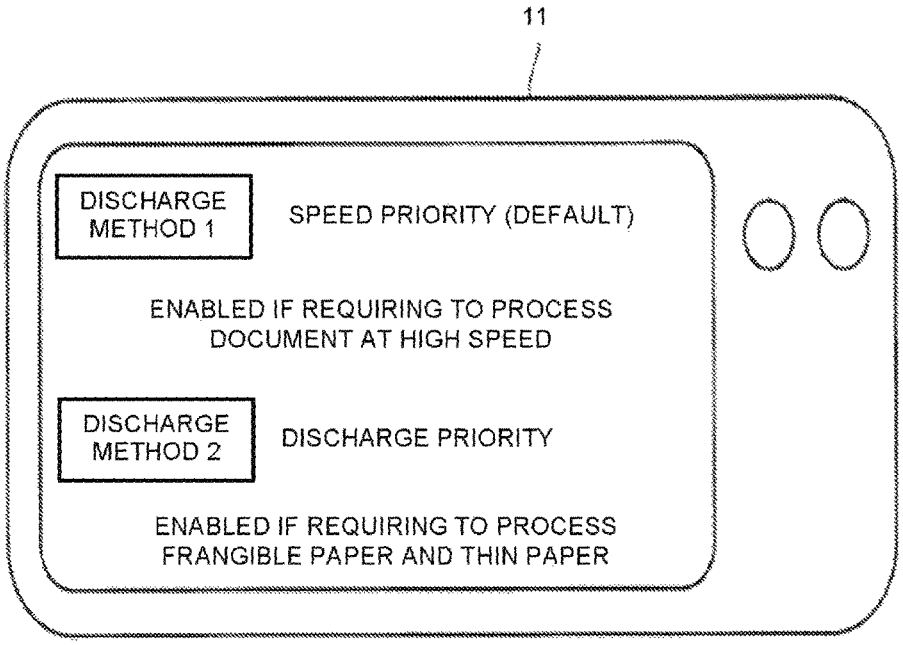
FIG. 8 is a front view illustrating a control panel of an image forming system according to an embodiment.

FIG. 8 shows an example of a touch panel of the control panel. A "discharge method 1" in FIG. 8 is a default setting, which is a sheet discharge method using the bundle claw 57. In this case, it is effective for speeding up the sheet processing. A "discharge method 2" in FIG. 8 is a sheet discharge method using the pinch roller 61 and the conveyance roller 59. In this case, it is effective for conveying the sheet S which is soft and large in size and low in rigidity.

Figure 9:
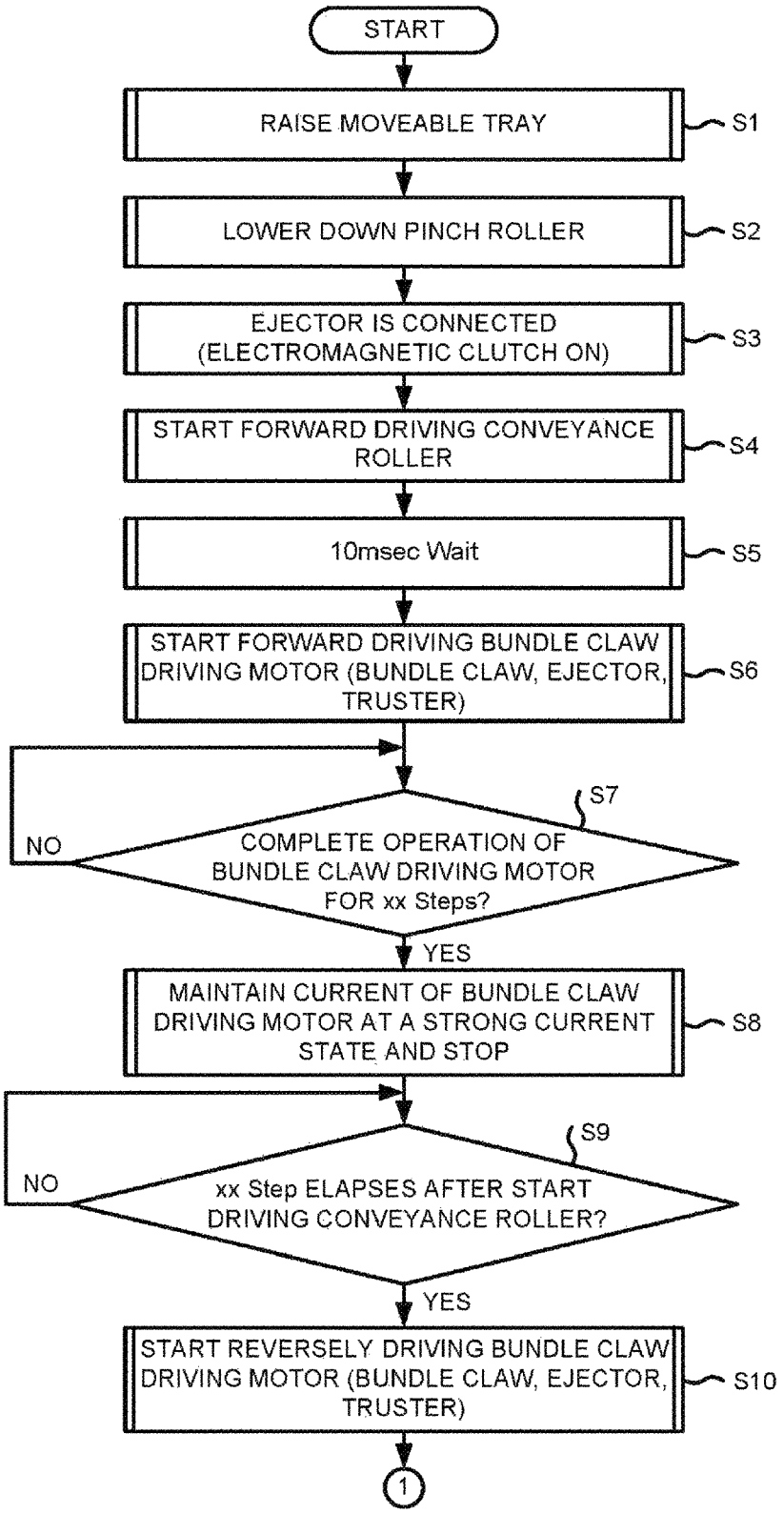
FIG. 9 is a first flowchart illustrating a processing of a post-processing apparatus according to an embodiment.
Figure 10:
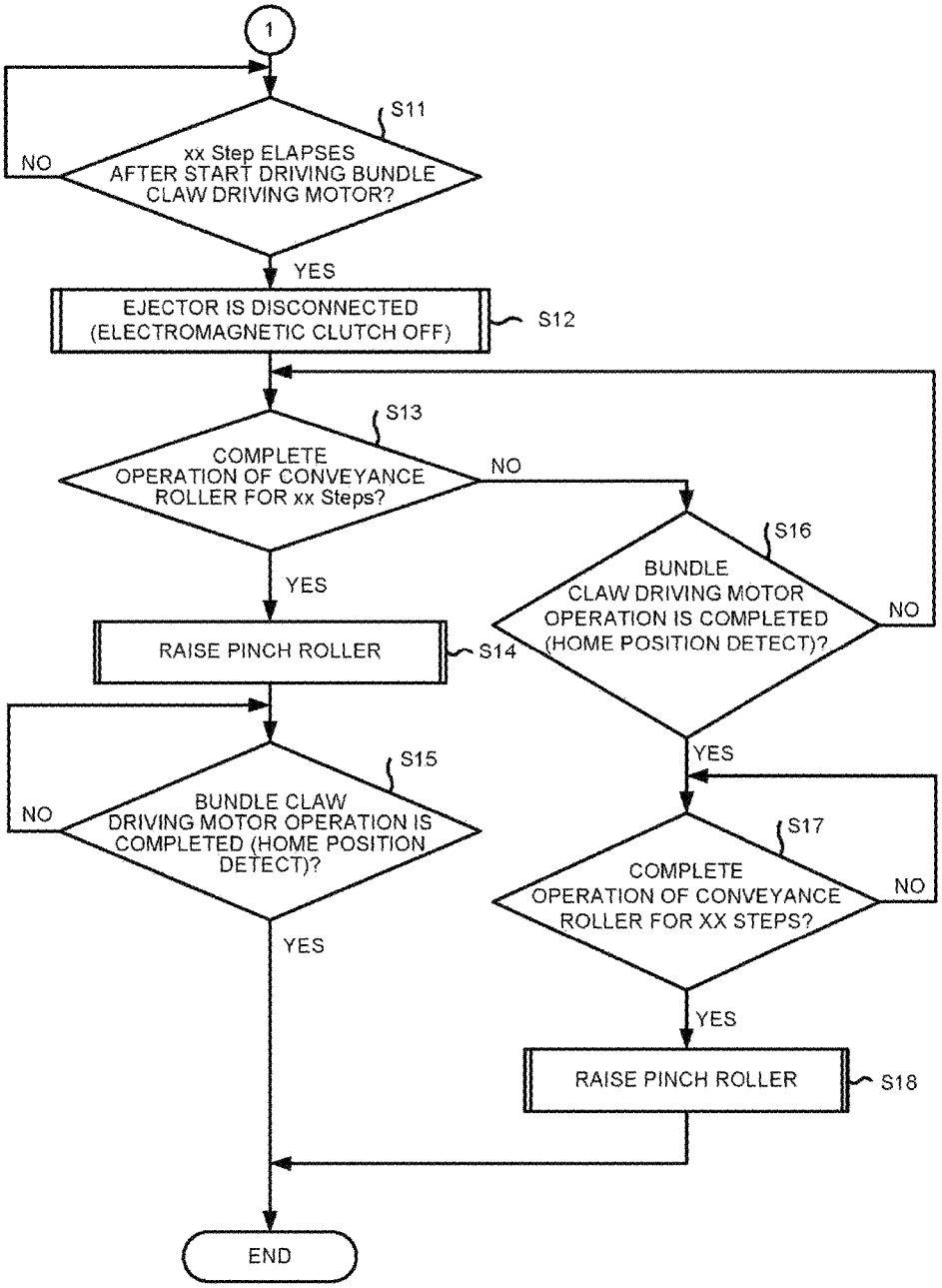
FIG. 10 is a second flowchart illustrating processing of a post-processing apparatus according to an embodiment.

An example of the processing executed by the post-processing controller 24 in a case of conveying the sheet S using the pinch roller 61 and the conveyance roller 59 after the post-processing of the sheet S is described with reference to the flowcharts in FIG. 9 and FIG. 10. The control flow shown in FIG. 9 and FIG. 10 is repeatedly executed at a prescribed cycle if the power source of the post-processing apparatus 3 is ON (the main switch is ON).

First, in Act S1, the movable tray 23*b* is raised appropriately and moved to the standby position (refer to FIG. 3), and the step of the movable tray 23*b* and the processing tray 51 is changed by raising the movable tray 23*b*. The standby position is a position lower than the protruding position of the thruster 56*a*, and avoids breakage of parts due to interference with the thruster 56*a*.

In Act S2, the solenoid 63 is energized to lower the pinch roller 61, and the sheet bundle SS is sandwiched between the pinch roller 61 and the conveyance roller 59 (refer to FIG. 4). As described above, the timing at which the pinch roller 61 sandwiches the sheet bundle SS is shifted from the timing at which the stapler 55 binds the sheet bundle SS.

In Act S3, the bundle claw driving motor 65 and the ejector 56 are connected so as to transmit the power therebetween. The electromagnetic clutch 66 is energized to turn on the electromagnetic clutch 66 (connection state).

In Act S4, the forward rotation of the conveyance roller 59 is started. The operation for conveying the sheet bundle SS on the processing tray 51 in the discharge direction is started. In Act S5, the conveyance operation of the sheet bundle SS is maintained only for a specified time (for example 10 msec).

Figure 5:
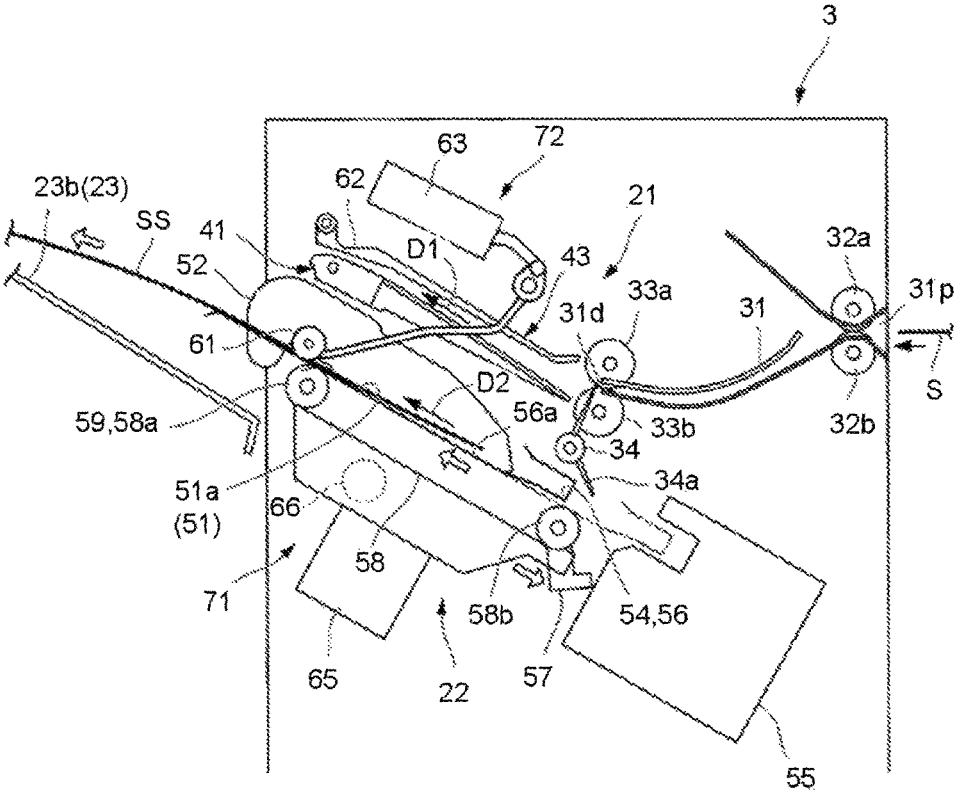
FIG. 5 is a side view illustrating a second operation by a post-processing apparatus according to an embodiment.

In Act S6, driving of the bundle claw driving motor 65 is started (refer to FIG. 5). As a result, the bundle claw 57 starts moving from the home position HP along the winding direction of the bundle claw belt 58. At this time, since the electromagnetic clutch 66 is in a connected state, the ejector 56 and the thruster 56*a* are moved to the downstream side in the conveyance direction by the driving force of the bundle claw driving motor 65. Since driving of the bundle claw driving motor 65 starts after the specified time elapses in Act S5, the bundle claw 57, the ejector 56 and the thruster 56*a* start moving later than the sheet bundle SS.

In Act S7, it is determined whether or not the bundle claw driving motor 65 completes the operation for the specified number of steps. If YES is taken in Act S7, the ejector 56 and the thruster 56*a* move by a specified amount to the downstream side in the conveyance direction (in particular, a state in which the thruster 56*a* is suitable for supporting conveyance of the sheet bundle SS).

In Act S8, the electric current to the bundle claw driving motor 65 is maintained in a high electricity state, and the state in which the ejector 56 and the thruster 56*a* maintains a state of moving to the downstream side in the conveyance direction against the energization force of the ejector 56 and the thruster 56*a*. The thruster 56*a* maintains a state suitable for conveyance support of the sheet bundle SS.

In Act S9, it is determined whether or not the conveyance roller 59 completes the operation for the specified number of steps. If YES is taken in Act S9, the sheet bundle SS is discharged from the processing tray 51, or in a state nearing discharge.

Figure 6:
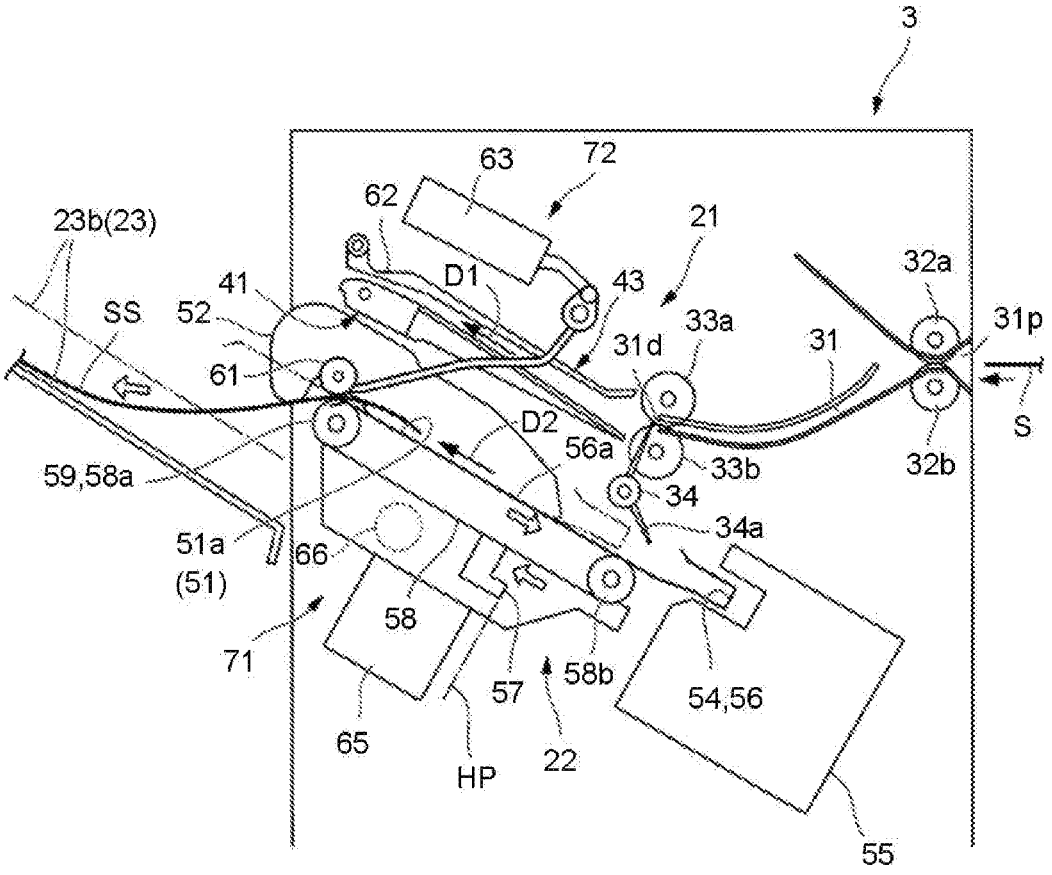
FIG. 6 is a side view illustrating a third operation by a post-processing apparatus according to an embodiment.
Figure 7:
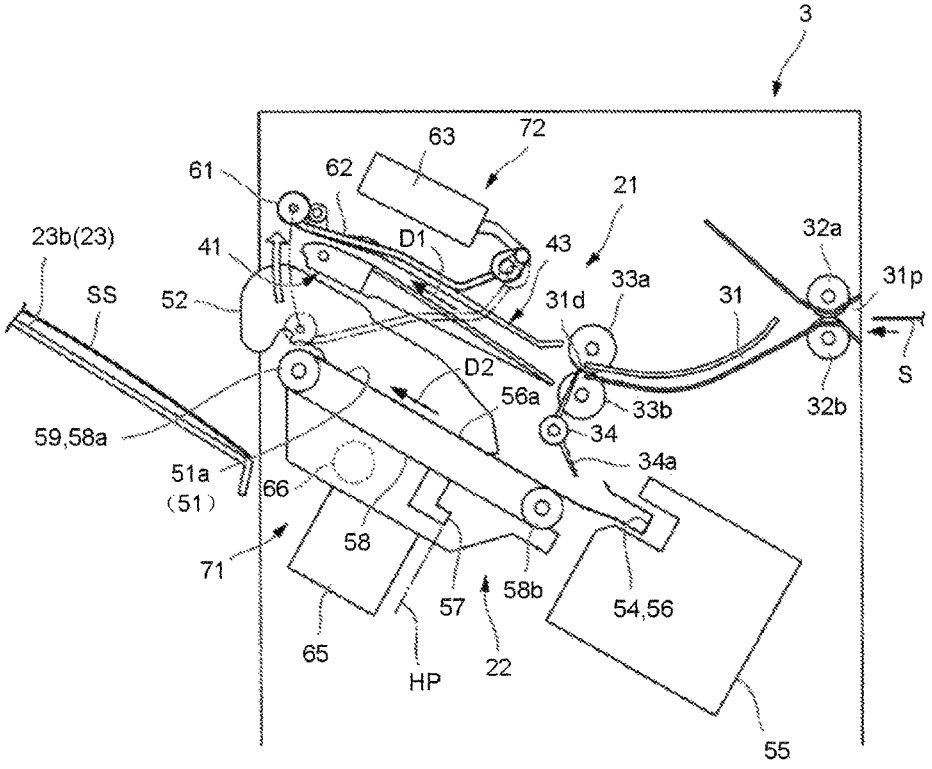
FIG. 7 is a side view illustrating a fourth operation by a post-processing apparatus according to an embodiment.

In Act S10, the reverse drive of the bundle claw driving motor 65 is started (refer to FIG. 6). As a result, the bundle claw 57 is fed back to the home position HP side along the winding direction of the bundle claw belt 58. The ejector 56 and the thruster 56*a* are sent back to the upstream side in the conveyance direction. In FIG. 6, the movable tray 23*b* descends according to the discharge of the sheet S.

In Act S11, it is determined whether or not the bundle claw driving motor 65 completes the operation for the specified number of steps, and if YES is taken in Act S11, in Act S12, the bundle claw driving motor 65 and the ejector 56 are apart from each other to be unable to transmit power. The electromagnetic clutch 66 is cut off and the electromagnetic clutch 66 is turned off (disconnected state).

By reversely rotating the ejector 56 and the thruster 56*a* backward in Act S10 and Act S11 and then disconnecting the electromagnetic clutch 66, the impact sound at the time the ejector 56 and the thruster 56*a* return to the initial position by the energization force of the ejector 56 and the thruster 56*a* is reduced. The electromagnetic clutch 66 may be cut off without executing a processing in Act S10 and Act S11.

In Act S13, it is determined whether or not the conveyance roller 59 completes the operation for the specified number of steps. If YES taken in Act S13, it is considered that the discharge of the sheet bundle SS is completed, and in Act S14, the pinch roller 61 is raised (refer to FIG. 7). Next, in Act S15, it is determines whether or not the operation of the bundle claw driving motor 65 is completed (whether or not that the bundle claw 57 at the home position HP is detected). If YES taken in Act S15, the processing is ended.

In the case of NO is taken in Act S13, in Act S16, it is determined whether or not the operation of the bundle claw driving motor 65 is completed (whether or not that the bundle claw 57 is in the home position HP is completed). If NO is taken in Act S16, the processing returns to Act S13. If YES is taken in Act S16, in Act S17, it is determined whether or not the conveyance roller 59 completes the operation for the specified number of steps. It is determined whether or not the conveyance roller 59 completes the operation for the specified number of steps. In case in which YES is taken in Act S17, it is regarded that the discharge of the sheet bundle SS is completed, the pinch roller 61 is raised in Act S18, and the processing is ended.

In the above embodiment, the post-processing apparatus 3 is separated from the image forming apparatus 2, but for example, the sheet processing apparatus may be the image forming apparatus having an in-body finisher inside the casing. The stapler 55 is provided as the sheet stapling processing section, but for example, the sheet stapling processing section using an adhesive tape may be provided.

According to at least one embodiment described above, even in a case of conveying the long sheet S such as A3 from the processing tray 51 with a thin and soft sheet S, it is possible to suppress the conveyance failure of the sheet S. In contrast to the sheet conveyance by the bundle claw 57, it is possible to suppress the conveyance failure of the sheet S by suppressing buckling of the sheet S regardless of the size or type of the sheet S.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of embodiments described herein may be made without departing from the spirit of the invention. The accompanying claims and their equivalents are intended to cover such forms or modifications as would fall within the scope and spirit of the invention.

What is claimed is:

1. A sheet processing apparatus, comprising:

a processing tray configured to place a sheet subjected to post-processing;

a conveyance roller, arranged at a downstream side of the processing tray in a sheet conveyance direction, configured to convey the sheet to the downstream side in the sheet conveyance direction;

an extrusion member configured to extrude an end of an upstream side in the sheet conveyance direction of the sheet placed on the processing tray from the upstream side to the downstream side in the sheet conveyance direction to convey the sheet to the downstream side in the sheet conveyance direction;

a pinch roller configured to move between a standby position distal from the conveyance roller and a rotation position closer to the conveyance roller than the standby position, and to move to the rotation position at the time of conveying the sheet by the conveyance roller to sandwich the sheet with the conveyance roller;

a controller configured to control the pinch roller and the conveyance roller to convey the sheet by the pinch roller and the conveyance roller when the sheet placed on the processing tray is conveyed to the downstream side in the sheet conveyance direction, and a downstream side guide member configured to be moved to the downstream side in the sheet conveyance direction together with an upstream side movement member to be moved in or moved out of the downstream side in the sheet conveyance direction of the conveyance roller, wherein the controller is configured to cause the downstream side guide member to be moved to the upstream side before completion of conveyance of the sheet placed on the processing tray, wherein the upstream side movement member is configured to abut against the end of the upstream side in the sheet conveyance direction of the sheet placed on the processing tray to move to the downstream side in the sheet conveyance direction, and wherein the controller is configured to cause the extrusion member and the upstream side movement member to move to the downstream side in the sheet conveyance direction at a speed equal to or smaller than a sheet conveyance speed by the conveyance roller at the time of conveying the sheet by the conveyance roller.

2. The sheet processing apparatus according to claim 1, further comprising:

an alignment device configured to execute alignment processing of aligning the sheet placed on the processing tray in at least one direction of the sheet conveyance direction and a sheet width direction intersecting the sheet conveyance direction, wherein the controller is configured to cause the pinch roller to move from the standby position to the rotation position after the alignment processing is completed.

3. The sheet processing apparatus according to claim 1, wherein the controller is configured to change the sheet conveyance speed by the conveyance roller based on at least one of a size or a type of the sheet placed on the processing tray.

4. The sheet processing apparatus according to claim 1, further comprising:

a stapling processing section configured to execute sheet stapling processing on a sheet bundle comprising a plurality of sheets placed on the processing tray, wherein the controller is configured to cause a timing of an operation of sandwiching the sheet bundle between the pinch roller and the conveyance roller to deviate from a timing of an operation of stapling the sheet bundle by the stapling processing section.

5. The sheet processing apparatus according to claim 1, wherein the controller is configured to switch sheet conveyance by the extrusion member and sheet conveyance by the pinch roller and the conveyance roller based on a number of sheets in a sheet bundle comprising a plurality of sheets placed on the processing tray.

6. The sheet processing apparatus according to claim 1, further comprising:

an operation section configured to receive an input from a user, wherein the controller is configured to switch the sheet conveyance by the extrusion member and the sheet conveyance by the pinch roller and the conveyance roller based on an input received by the operation section.

* * * * *